US008590471B2

(12) United States Patent
Connolly

(10) Patent No.: US 8,590,471 B2
(45) Date of Patent: Nov. 26, 2013

(54) OIL LEAK CONTAINMENT SYSTEM FOR A SHIP HARD AGROUND

(76) Inventor: John Connolly Connolly, Sausalito, CA (US)

( * ) Notice: Subject to any disclaimer, the term of this patent is extended or adjusted under 35 U.S.C. 154(b) by 0 days.

(21) Appl. No.: 13/310,692

(22) Filed: Dec. 2, 2011

(65) Prior Publication Data

US 2013/0139740 A1 Jun. 6, 2013

(51) Int. Cl.
*B63B 43/16* (2006.01)

(52) U.S. Cl.
USPC ..... 114/229; 405/63

(58) Field of Classification Search
USPC ..... 114/227, 229; 405/63
See application file for complete search history.

(56) References Cited

U.S. PATENT DOCUMENTS

| | | | | |
|---|---|---|---|---|
| 5,143,012 | A * | 9/1992 | Elkowitz | 114/227 |
| 5,195,446 | A * | 3/1993 | Riddell | 114/229 |
| 5,203,273 | A * | 4/1993 | Sandlofer | 114/229 |
| 5,216,973 | A * | 6/1993 | Gwinn | 114/229 |
| 5,685,252 | A * | 11/1997 | Prysner | 114/229 |
| 7,008,139 | B2 * | 3/2006 | Nilsen | 405/63 |

* cited by examiner

*Primary Examiner* — Lars A Olson
*Assistant Examiner* — Jovon Hayes

(57) ABSTRACT

A leak prevention device and method of use to prevent leakage and sinkage of ships that have collided with immobile objects comprising at least two inflatable cylindrical bodies that have cables attached to each of its ends. The cylinders are lowered over one side of a ship or delivered by rescue vessels and then manipulated by the cables or guide wires, one past the stern of the ship and the other past the bow of the ship so that the lines are on the opposite side of the ship, so that guide-wires pass under the hull of the ship and surround the object of the collision fully on one side. The process is repeated on the opposite side of the ship so that the two cylindrical structures crisscross. The cables are then tensioned and inflated with compressed air forming a tight seal between the hull and the point of collision.

4 Claims, 7 Drawing Sheets

OIL LEAK CONTAINMENT SYSTEM FOR A SHIP HARD AGROUND

BACKGROUND OF THE INVENTION

1. Field of Invention

The invention relates to the field of oil leak prevention pertaining to ships that are hard aground. More specifically the prevention of fluid leaking out of a vessel that has had its hull compromised by, for example, an immobile object, such as a rock, debris or iceberg.

2. Related Art

There is a constant danger that any seagoing or waterborne craft may collide with a submerged object and therefore sink. The most famous occurrence of such event was the fate of the USS Titanic when it encountered an iceberg. There are thousands more examples of ships either sinking from contacting some submerged object or of them leaking out all of their liquid cargo, such in the instance of an oil tanker breaching its hull, such as the Exxon Valdez which ran aground onto a reef in Alaska, spilling roughly 11,000,000 of crude oil and causing significant damage to the environment and ecosystem. Without enumerating the damage and cost of these types of accidents it is very easy to see that the toll in lives lost, economic and environment costs can be very high.

Therefore it has been contemplated to solve the problem of a breached hull in many different fashions. These attempts have varied in approaches in the instance that one is preventing fluid from flowing out of the vessel, such as in an oil tanker or whether they are preventing fluid from flowing into the vessel, such as in a non-liquid hauling vessel.

One family of approaches is to apply a patch directly over the breach, the most rudimentary would be to weld steel plates to a ruptured steel hull or there have been attempts to "bandage" the opening with some relatively pliable water proof material until a permanent solution can be reached.

Another set of approaches applicable to a fluid leak is containing the fluid in the water. Since most leaks involve oil or similar substances that are lighter than water and they rise to the surface many approaches take advantage of this phenomenon by using floating booms or barriers to contain the material until it can be removed, by skimming procedures.

Although these approaches have merit and may be used in combination with each other or with different approaches there are situations where the vessel cannot be dislodged from the object of contact or it may be undesirable because it may cause the vessel to sink immediately. In this situation the rock or debris is actually partially sealing the breach.

It is therefore a primary object of this inventive material to prevent hull leakage or water intrusion by sealing the hull to the object of contact.

It is another object of the invention to have a device that is stored near land and made available to a region where a special emergency team is trained to deploy it is response to a ship running hard aground.

It is another object of the inventive material to have a device that is easily stored and deployed on vessels by utilizing existing machinery and equipment typically onboard.

BRIEF SUMMARY

According to one general embodiment, an oil leak containment system for a ship hard aground that comprises at least one elongated flexible inflatable cylindrical structure that has two ends and a center with a guide wire affixed to each end of the cylindrical structure; as well as a means to inflate the structure.

In another embodiment, a method of preventing leaks from a ship that has run aground is for an emergency response team to bring an inflatable, expandable and flexible cylindrical structure that has guide-wires on both ends to the side of a ship near the point of collision and then manipulating the guide-wires, one past the stern of the ship and the other past the bow of the ship so that the lines are on the opposite side of the ship roughly opposite the breach. Once so located the guide-wires are attached to winches on the deck of the ship and are tensioned, so that guide-wires pass under the hull of the ship and surround the object of the collision fully on the side of the ship nearest the collision. The process is repeated on the opposite side of the ship so that the two cylindrical structures crisscross and seal the ship to the point of collision with a rock, reef or iceberg. Finally the cylindrical structures are inflated with compressed air to form a tight seal between the obstruction and the hull of the ship.

Other aspects and advantages of the present invention will become apparent from the following detailed description which when taken in conjunction with the drawings, illustrates by way of example the principles and structure of the invention.

BRIEF DESCRIPTION OF THE DRAWINGS

Taking the following specifications in conjunction with the accompanying drawings will cause the invention to be better understood regarding these and other features and advantages. The specifications reference the annexed drawings wherein.

DETAILED DESCRIPTION OF THE PREFERRED EMBODIMENTS

While describing the invention and its embodiments, various terms will be used for the sake of clarity. These terms are intended to not only include the recited embodiments, but also all equivalents that perform substantially the same function, in substantially the same manner to achieve the same result.

The current inventive material is intended to utilize equipment commonly available in the marine industry such as air compressors, cable winches, guide-wires, lines and methods common to seamen.

Figure 1:
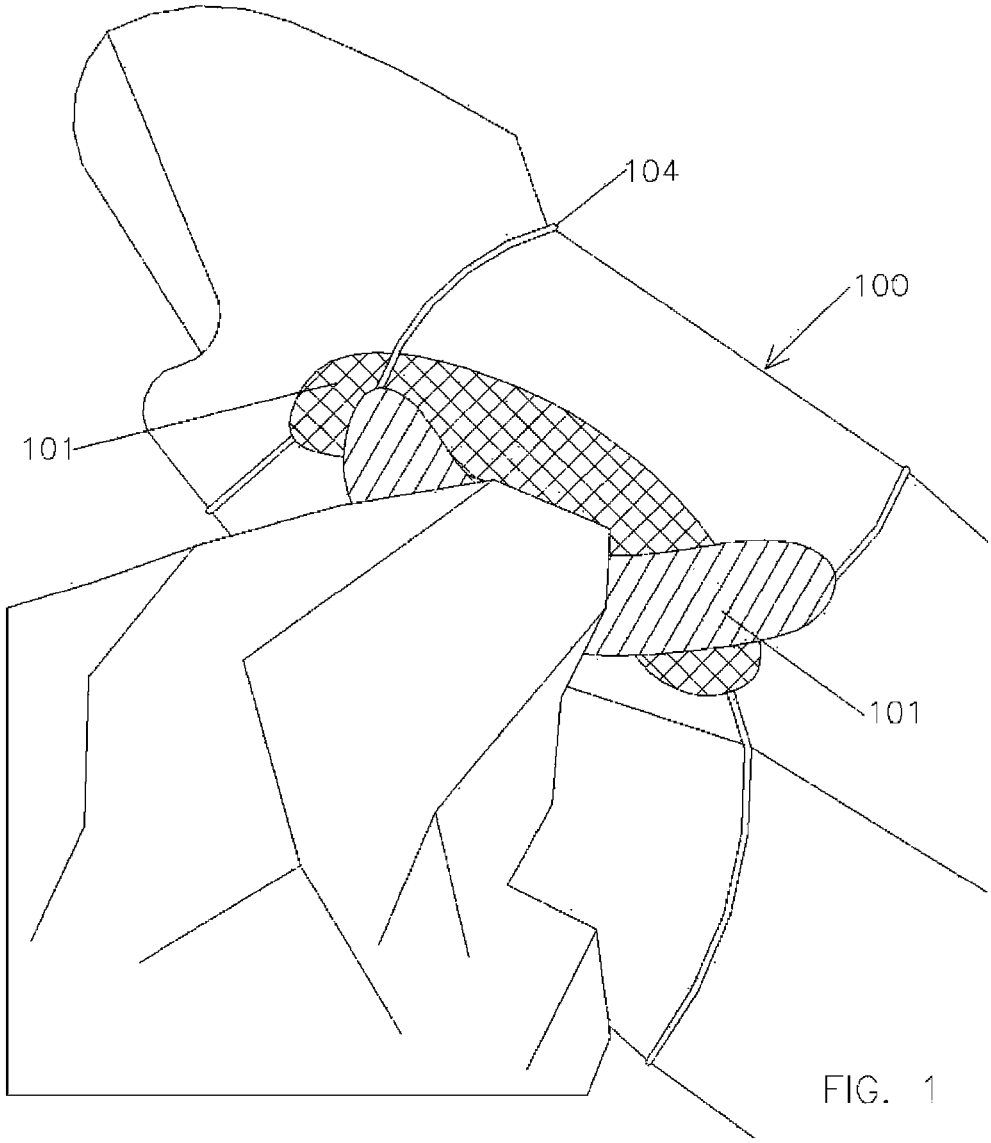
FIG. 1 is a bottom perspective view of a vessel and oil leak containment system in place. damaged ship.

Referring to FIG. 1, a bottom perspective view of an oil leak containment system for a ship hard aground in deployed generally reference by the numeral 101 for sealing a damaged hull and preventing the vessel leaking its viscous cargo or fuel stores. In one embodiment, a hull seal 101 comprises a cylindrical seal that is an elongated inflatable flexible member with a diameter and a length and the cylindrical seal has an external diameter of roughly 1 foot when deflated and a length of more than 100 feet. The seal is fashioned from a rugged chemical and petroleum resistant material that is flexible and cloth-like, but can be fashioned to be resistant to any type of liquids found aboard shipping vessels, such as solvents and the like. At roughly the midpoint of the seal there is attached an inflation line 102, please refer to FIG. 8*c*, it is contemplated that this line is an air line that connects with the air compressor aboard the ship or vessel. At each end of the cylindrical seal 101 are affixed ropes or cables 104 which are used to position and manipulate the device 101 around the ship or vessel 100.

Figure 2A:
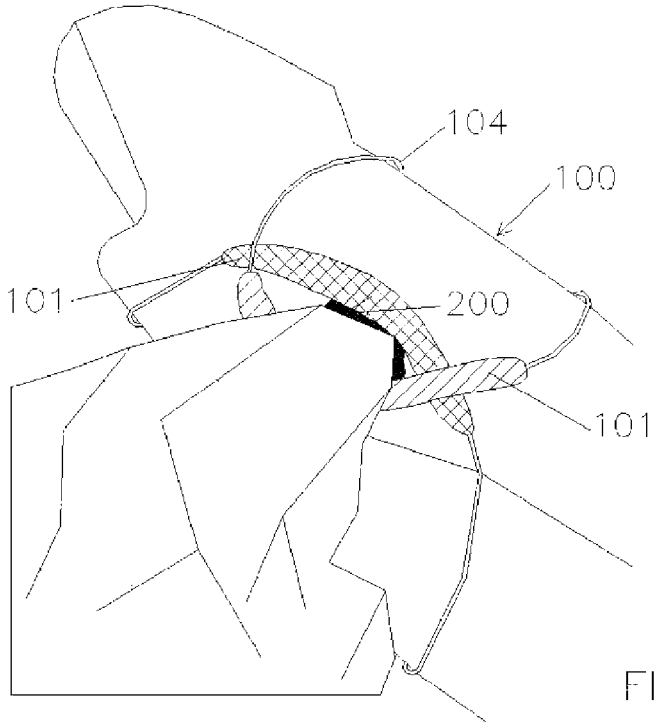
FIG. 2*a* is analogous to FIG. 1
Figure 3A:
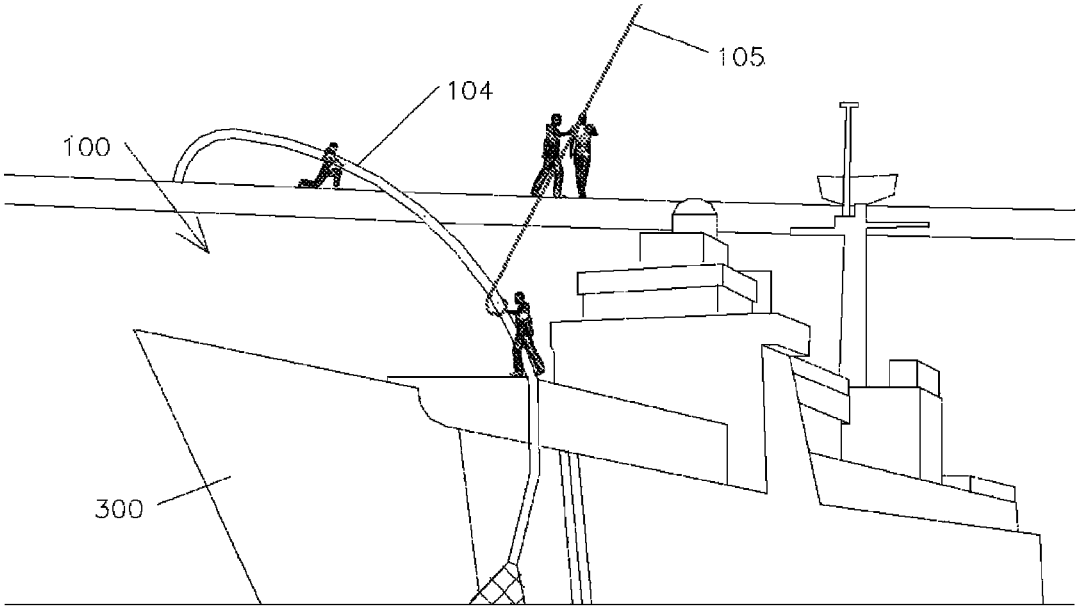
FIG. 3*a* is a perspective side view of a crew deploying the device.
Figure 3B:
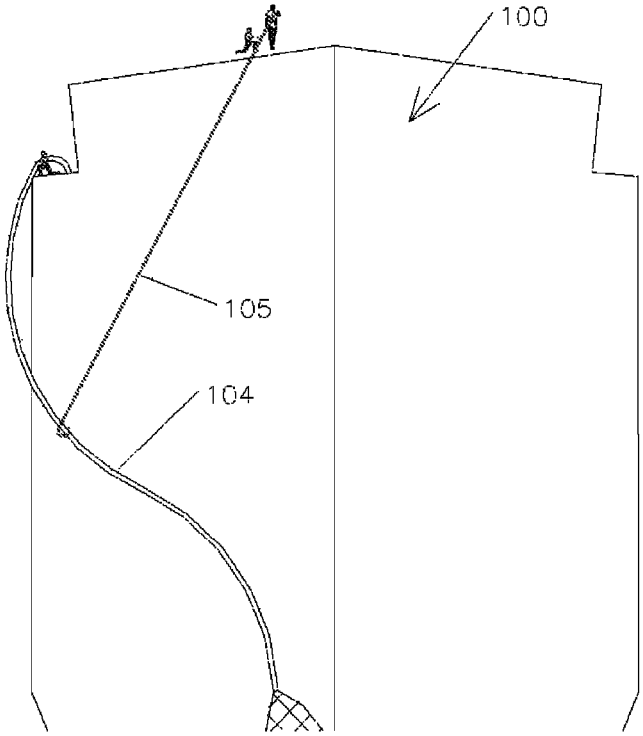
FIG. 3*b* is a perspective side view of a crew positioning the device.

Now referring to FIGS. 3*a* and 3*b*. Views of the deployment of the hull seal 101 by a crew aboard a vessel. The device 101 is brought to the side of the vessel 100 directly above or close to the point of damage, in the instant figures the device 101 is being positioned on the port side of the vessel 100. As the device 101 is being positioned in the water, the first cable 104 is manipulated around the bow of the vessel and secured directly opposite the point of contact, in this case on the starboard side of the vessel 100. The cable can be directed by the use of such devices as a Sheppard's hook or pole 105. The second cable 104 (not shown in this view) is likewise manipulated and anchored on the starboard side, but by progression around the stern or back of the ship. This procedure is repeated on the starboard side of the vessel with an identical seal 101, so that the two seals overlap and surround the point of impact 200 as can be seen in FIG. 2*a*, not shown in these diagrams. In one embodiment the cables are attached to lightweight leader lines or ropes, so that they can be more easily manipulated around the ship. Once the two seals 101 are in place the devices are inflated forming a seal between the vessel and the point of impact.

Figure 2B:
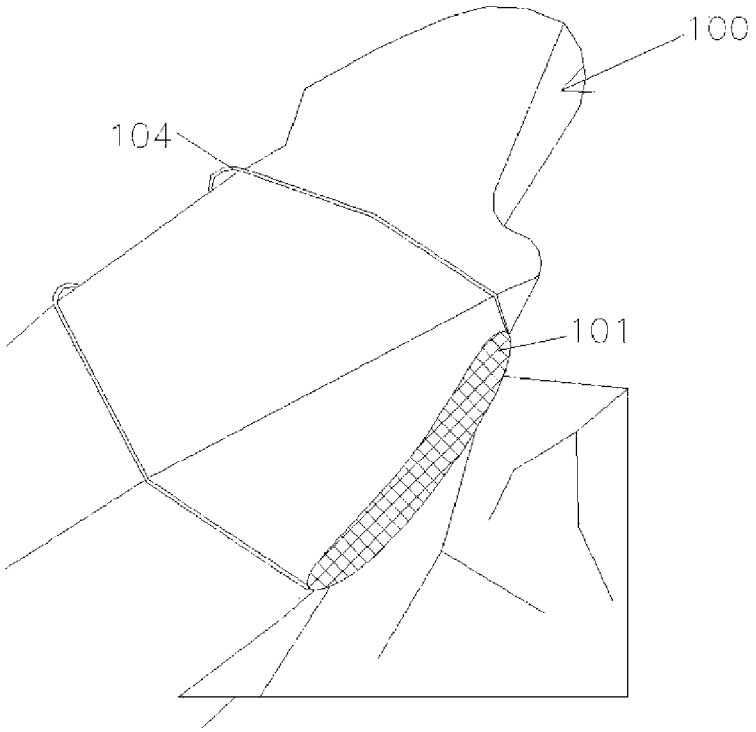
FIG. 2*b* is a side perspective view of FIG. 1.

Continuing to refer to FIGS. 2*a* and 2*b* bottom perspective views of a vessel run aground and an oil leak containment system. Here the device 100 has been wrapped around the obstruction 200 in order to partially seal the breach or damage. In this view the device 101 has been secured on the port side with the cables 104 attached to winches or pulleys—not shown to provide tension to the device 100 and secure it against the obstruction 200. In some instances the use of a single device 101 may be adequate to prevent leakage; this of course is dependent on the damage done and the location of the damage, as seen in FIG. 2*b*.

Figure 4:
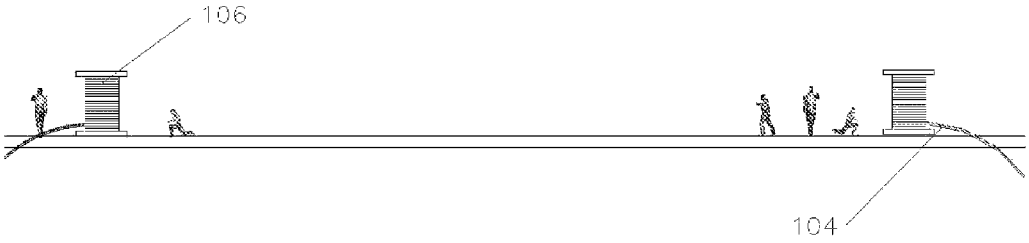
FIG. 4 is side view of a crew deploying the devices cables.
Figure 5:
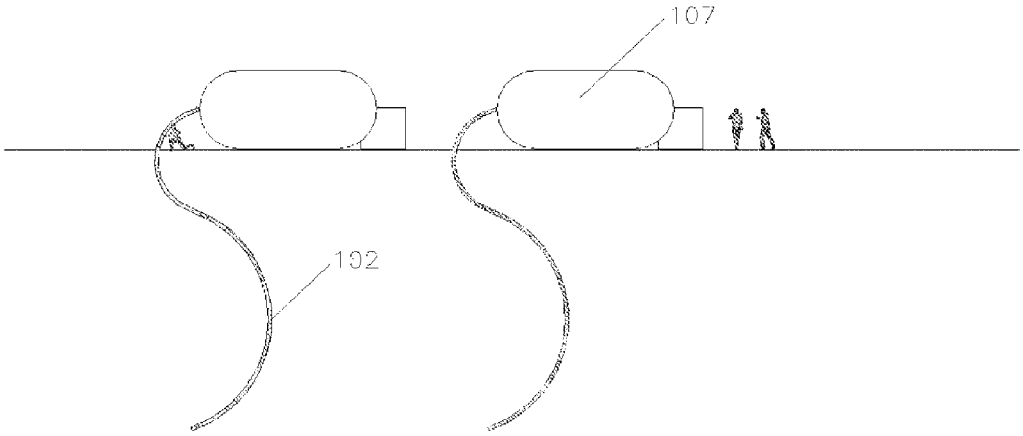
FIG. 5 is a side view of a crew utilizing air compressors to inflate the device.

Now referring to FIGS. 4 and 5 portrayal of typical equipment aboard a vessel, such as cable winches 106, heavy cables 104, air compressors or tanks 107 and pneumatic lines 102 for inflating the containment system.

Figure 6:
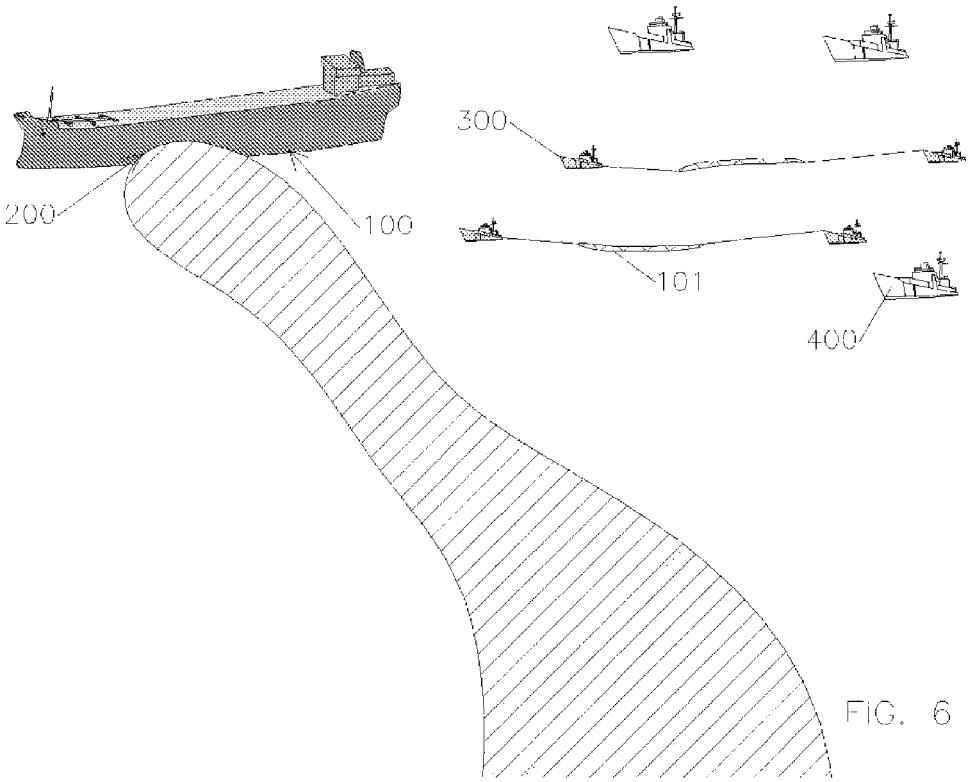
FIG. 6 is an aerial perspective of a rescue crew deploying the device.
Figure 7A:
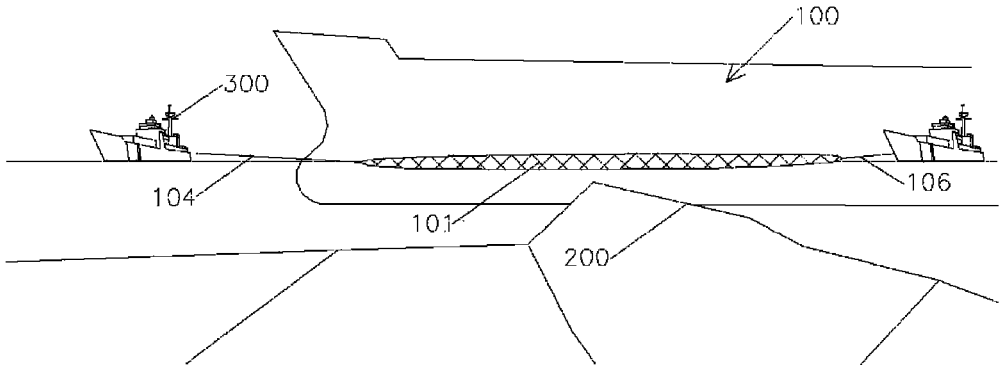
FIG. 7*a* is a side view of a rescue crew deploying the device.
Figure 7B:
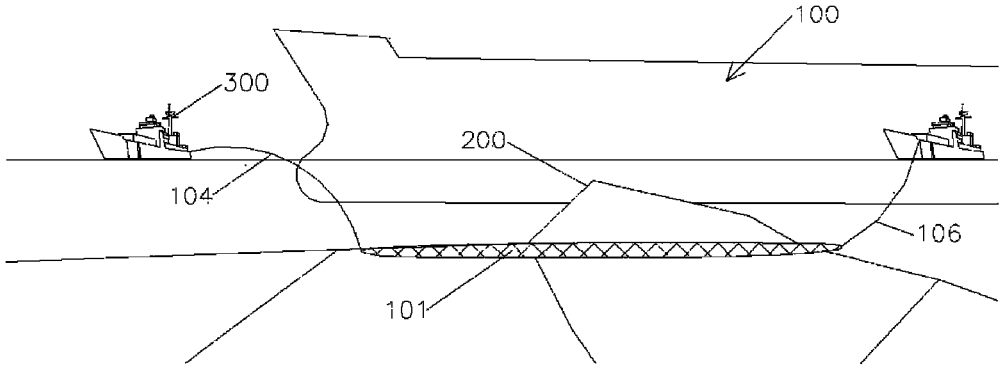
FIG. 7*b*. is analogous to FIG. 7*a*.

Now referring to FIGS. 6 and 7, perspective views of an alternate embodiment of deploying the oil leak containment system 101 whereby the device is not stored on the vessel itself by rather delivered by rescue or response vessels 300 and 400. Response vessels 300 work in tandem pulling or guiding the device 101 by attachment cables 104, 106 and then navigating around the bow or stern of the distressed vessel 100 and the object of which the vessel has run aground 200. It has been contemplated that the device be partially inflated so as to increase its buoyancy and ease of transport, then deflated so that it would sink and surround the object 200 and then once tensioned or cinched up re-inflated to perform the sealing process. It has been further contemplated to either keep the cables 104 and 106 affixed to the rescue vessels 300, so that they can adjust and maneuver the seal to correct for tidal variation or the ships movement, or the cables can be delivered to the deck of the distressed vessel 100 for securing or a combination of the two. Once the hull is sealed clean up can commence.

Figure 8A:
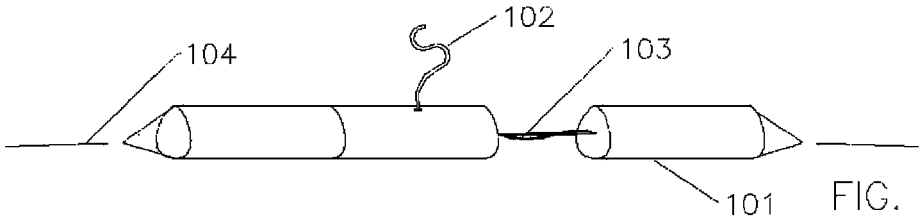
FIG. 8*a* is as close up side view of an embodiment of the device.
Figure 8B:
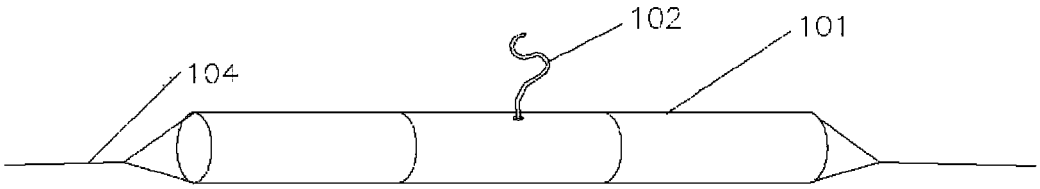
FIG. 8*b* is as close up side view of an embodiment of the device.
Figure 8C:
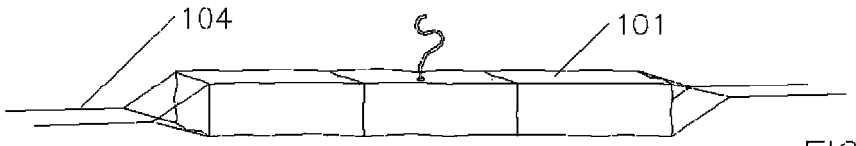
FIG. 8*c* is as close up side view of an embodiment of the device.
Figure 8D:
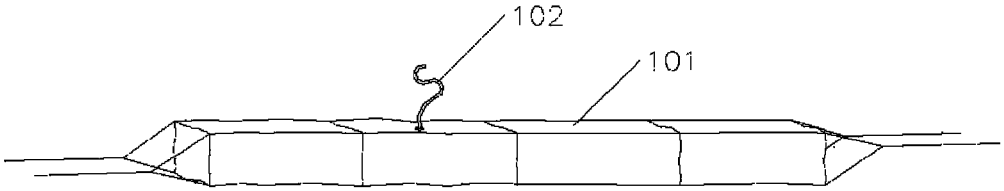
FIG. 8*d* is as close up side view of an embodiment of the device.

Now referring to FIGS. 8*a*-8*d* perspective views of various embodiments of the seal 100 wherein various geometries have been proposed, such as rectangular and cylindrical as well as alternative means of securing the cables to the seal 101. FIG. 8*a* depicts a central cable 103 running though the length of the seal 101, wherein the seal is a collection of several short seals connected end to end, so that the device is segmented and can be of virtually any length by adding or removing sections. FIGS. 8*b*-8*d* demonstrate the use of multiple cables 104 for added strength and the use of the cables continually throughout the perimeter of the seal 101, so that seal can be tensioned regardless of the tensile strength of the fabric that comprised the shell of the seal.

Figure 8E:
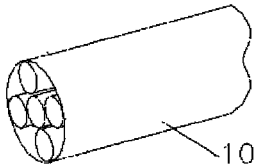
FIG. 8*e* is as close up cross sectional view of an embodiment of the device.
Figure 8F:
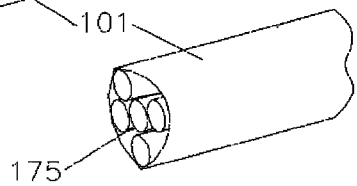
FIG. 8*f* is as close up cross sectional view of an embodiment of the device.
Figure 8G:
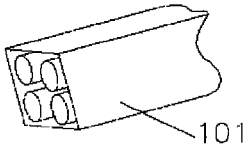
FIG. 8*g* is as close up cross sectional view of an embodiment of the device.

Now referring to FIGS. 8*e*-8*g* cross-sectional views of the hull seal according to alternative embodiments. In one embodiment the seal 101 comprises a hollow inflatable bladder or cells 175 which may be inflated with air to seal the leak. Another embodiment contemplates the use of several separate bladders within the seal that may be individually inflated. In another embodiment the seal 101 comprises bladder that may comprise a sponge-like material that expands when in contact with water, activation requires filling the seal 101 with water or having a membrane that is semi-water permeable, like Goretex™ so that after submersion the seal 101 will start to swell after the seal 101 has been put into position, alleviating the need for the use of an air compressor. In this embodiment a tear in the sox or seal 101 would have very little effect on its sealing properties. Although a cylindrical cross-section is the preferred embodiment, it has been further contemplated to adapt various geometries such as rectangular or triangular for different applications.

The invention has been described in terms of the preferred embodiment. One skilled in the art will recognize that it would be possible to construct the elements of the present invention from a variety of means and to modify the placement of the components in a variety of ways. While the embodiments of the invention have been described in detail and shown in the accompanying drawings, it will be evident that various further modifications are possible without departing from the scope of the invention as set forth in the following claims.

The invention claimed is:

1. A method of preventing leaks to a ship run aground comprising:

at least one elongated flexible inflatable cylindrical structure with two ends and a center;

lowering an inflatable expandable flexible cylindrical structure over the port side of a ship near the point of collision;

manipulating the guide-wires, one past the stem of the ship and the other past the bow of the ship so that the lines are on the starboard side of the ship directly opposite the breach;

attaching the guide-wires to winches on the deck of the ship;

tensioning the guide-wires so that they passed under the hull of the ship and surround the object of the collision fully on the port side of the ship;

lowering an inflatable expandable flexible cylindrical structure over the starboard side of a ship near the point of collision;

manipulating the guide-wires, one past the stem of the ship and the other past the bow of the ship so that the lines are on the port side of the ship directly opposite the breach;

attaching the guide-wires to winches on the deck of the ship;

tensioning the guide-wires so that they passed under the hull of the ship and surround the object of the collision fully on the starboard side of the ship;

inflating each cylinder to create a seal between the object of the collision, which is still embedded in said hull of the vessel, and the hull of the ship, and;

performing recovery of leaking material.

2. The device of claim 1 wherein the means of inflation is compressed air.

3. The device of claim 1 wherein the structure encapsulates a material that expands when in contact with water.

4. The device of claim 1 wherein the material surrounding the cylinder is a one way fabric allowing water in and not out.

* * * * *